US006608907B1

(12) United States Patent
Lee

(10) Patent No.: US 6,608,907 B1
(45) Date of Patent: Aug. 19, 2003

(54) AUDIO OUTPUT APPARATUS HAVING WIRELESS SPEAKERS

(75) Inventor: Sang-Hae Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/223,314

(22) Filed: Dec. 30, 1998

(30) Foreign Application Priority Data

Dec. 30, 1997 (KR) ..... 97/79758

(51) Int. Cl.[7] ..... H04R 5/02
(52) U.S. Cl. ..... 381/311; 381/334
(58) Field of Search ..... 381/77, 80, 17, 381/18, 334, 311; 375/141

(56) References Cited

U.S. PATENT DOCUMENTS 5,930,370 A * 7/1999 Ruzicka ..... 381/18
5,946,343 A * 8/1999 Schotz et al. ..... 375/141
6,064,699 A * 5/2000 Law ..... 375/244
6,307,842 B1 * 10/2001 Nakata et al. ..... 340/825.25

* cited by examiner

*Primary Examiner*—Ping Lee
(74) *Attorney, Agent, or Firm*—Robert E. Bushnell, Esq.

(57) ABSTRACT

An audio output apparatus having a wireless speaker is provided in an apparatus which outputs audio signal of 5.1 channel. In the audio output apparatus, an audio signal encoded in accordance with an IEEE 1394 protocol is received by a sub-woofer speaker through an IEEE 1394 communication line, is decoded in the sub-woofer speaker, is modulated by a spread spectrum FM modulation method, and is then transmitted to a plurality of wireless-connected speakers so as to be outputted. When the audio signal encoded by an IEEE 1394 communication protocol is outputted to the sub-woofer speaker through a first interface circuit, the encoded audio signal is, in accordance with a control signal from a controller provided in the sub-woofer speaker, received by a second interface circuit, and is decoded in real time by a decoder so as to output it externally while, at the same time, it is modulated by a spread spectrum FM modulation method, and is then transmitted to the wireless-connected plurality of speakers so as to be demodulated and outputted.

18 Claims, 3 Drawing Sheets

AUDIO OUTPUT APPARATUS HAVING WIRELESS SPEAKERS

CLAIM OF PRIORITY

This application makes reference to, incorporates the same herein, and claims all benefits accruing under 35 U.S.C. §119 from an application for AUDIO OUTPUT APPARATUS HAVING WIRELESS SPEAKERS earlier filed in the Korean Industrial Property Office on the 30$^{th}$ of December 1997 and there duly assigned Serial No. 79758/1997.

BACKGROUND OF THE INVENTION

1. Field of the Invention

The present invention relates to the class of electrical audio signal processing systems, and more particularly to wireless speaker systems.

2. Description of the Prior Art

In an exemplary computer apparatus having wired speakers in accordance with the conventional art, a plurality of speakers are wire-connected to a connection terminal of a speaker of a 5.1 channel provided to a computer apparatus. In t he computer apparatus having the above-described construction, a compressed audio signal is restored to an original audio signal and then is converted to an analog signal. The audio signal converted to the analog signal is transmitted to each of a front speaker, a central speaker, a rear speaker and a sub-woofer speaker by a wire connected to the connection terminal so as to be amplified and outputted.

The computer apparatus has a n audio signal compressed by an AC-3 method, by which the signal is converted so as to be finally outputted through the speaker, and this can be replaced by other audio output apparatus, such as an optical disk reproducer. The front speaker, central speaker, and rear speaker outputs are audio signals of 20 Hz–20 KHz. Most central speaker outputs are audio signals such as dialogue in movies. The rear speaker is commonly referred to as a surround speaker. The sub-woofer speaker, a speaker for reinforcing a middle and low sound, uses an output audio signal of low frequency of 20 Hz–900 Hz such as the boom of guns. Thus, five speakers use output audio signals in the same frequency, while one speaker uses an output audio signal of low frequency, hence the term 5.1 channel.

However, t he computer apparatus having wired speakers has a disadvantage in that, since the plurality of speakers of the 5.1 channel are wire-connected to the audio output apparatus in a limited space so as to output audio signals, wires connecting the audio output apparatus and the speakers are complicated to connect. Moreover, the wires tend to sag at the space where the audio output apparatus is placed. It can often be difficult for the user to run wires to the desired locations of the speakers. Thus, the arrangement of wires is both awkward and unaesthetic.

SUMMARY OF THE INVENTION

It is, therefore, an object of the present invention to provide an improved 5.1 channel audio apparatus.

It is a further object of the present invention to provide a 5.1 channel audio apparatus in which speaker connection is simple.

It is a yet further object of the invention to provide an apparatus in which there are no wires necessary to connect the main speakers.

The present invention provides an audio output apparatus having wireless speakers in which an audio signal, provided from an audio output apparatus which outputs a 5.1 channel audio signal, is received by a sub-woofer speaker through an IEEE 1394 communication line, is modulated by a spread spectrum FM modulation method, and then is transmitted to the plurality of wireless-connected speakers so as to be outputted.

More specifically, there is provided an audio output apparatus having wireless speakers in which, when an audio signal coded by an IEEE 1394 communication protocol is outputted to a sub-woofer speaker through a first interface circuit, the input coded audio signal in accordance with a control signal from a controller provided in the sub-woofer speaker is received by a second interface circuit, and is decoded in real time by a decoder so as to output it externally. At the same time, it is modulated by a spread spectrum FM modulation method, and then is transmitted to the wireless-connected plurality of speakers so as to be demodulated and outputted.

Additional advantages, objects and other features of the invention will be set forth in part in the description which follows, and in part will become apparent to those having ordinary skill in the art upon examination of the following, or may be learned from practice of the invention. The object and advantages of the invention may be realized and attained as particularly pointed out in the appended claims.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
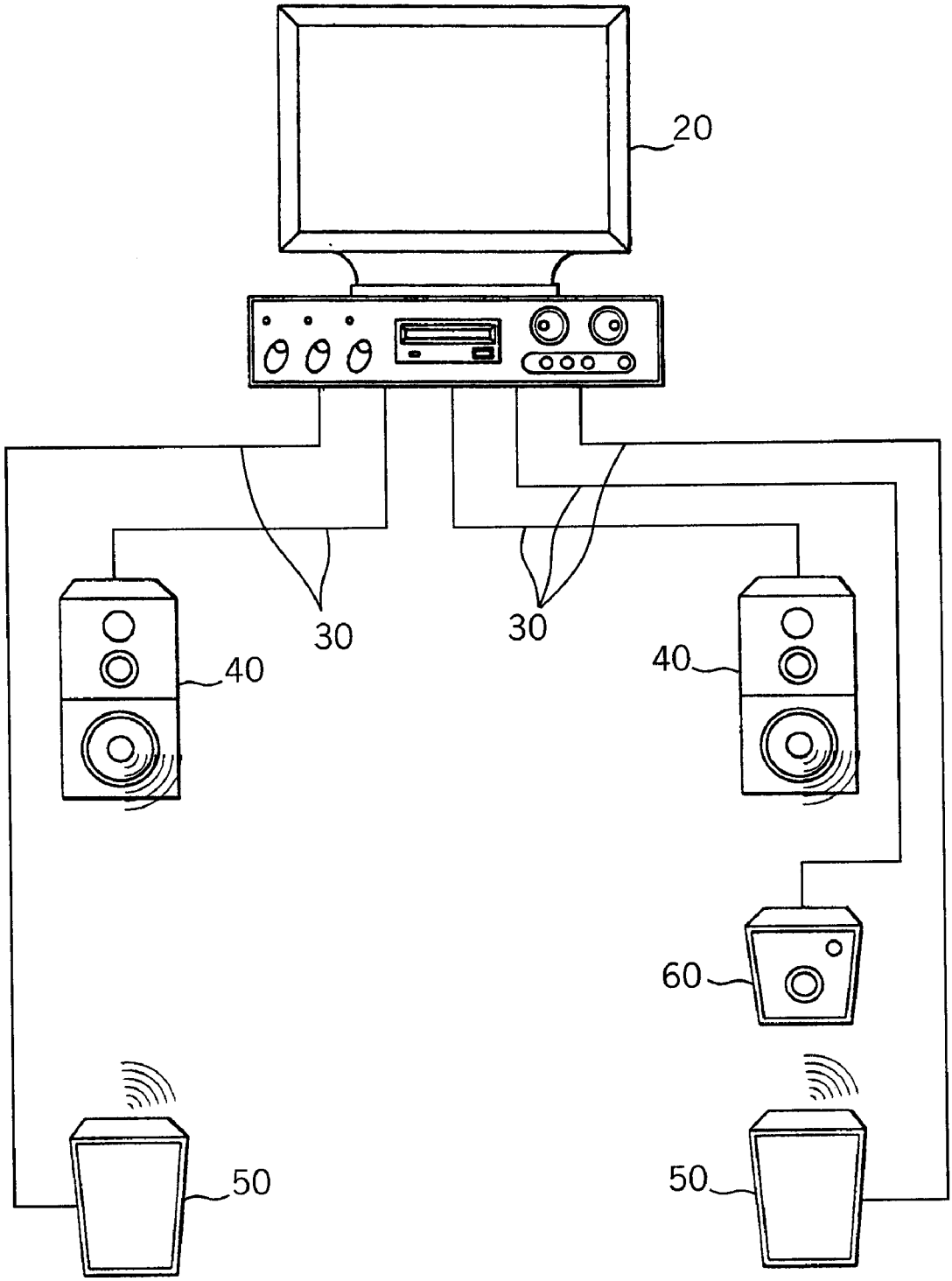
FIG. 1 illustrates a computer apparatus having wire speakers in a conventional art.

FIG. 1 shows an exemplary computer apparatus having wired speakers in accordance with the conventional art. As shown in this figure, a plurality of speakers are wire-connected to a connection terminal of a speaker of a 5.1 channel provided to a computer apparatus. Specifically, computer 20 is connected by sets of speaker wires 30 to a pair of front speakers 40, a pair of rear speakers 50 and a sub-woofer 60.

Figure 2:
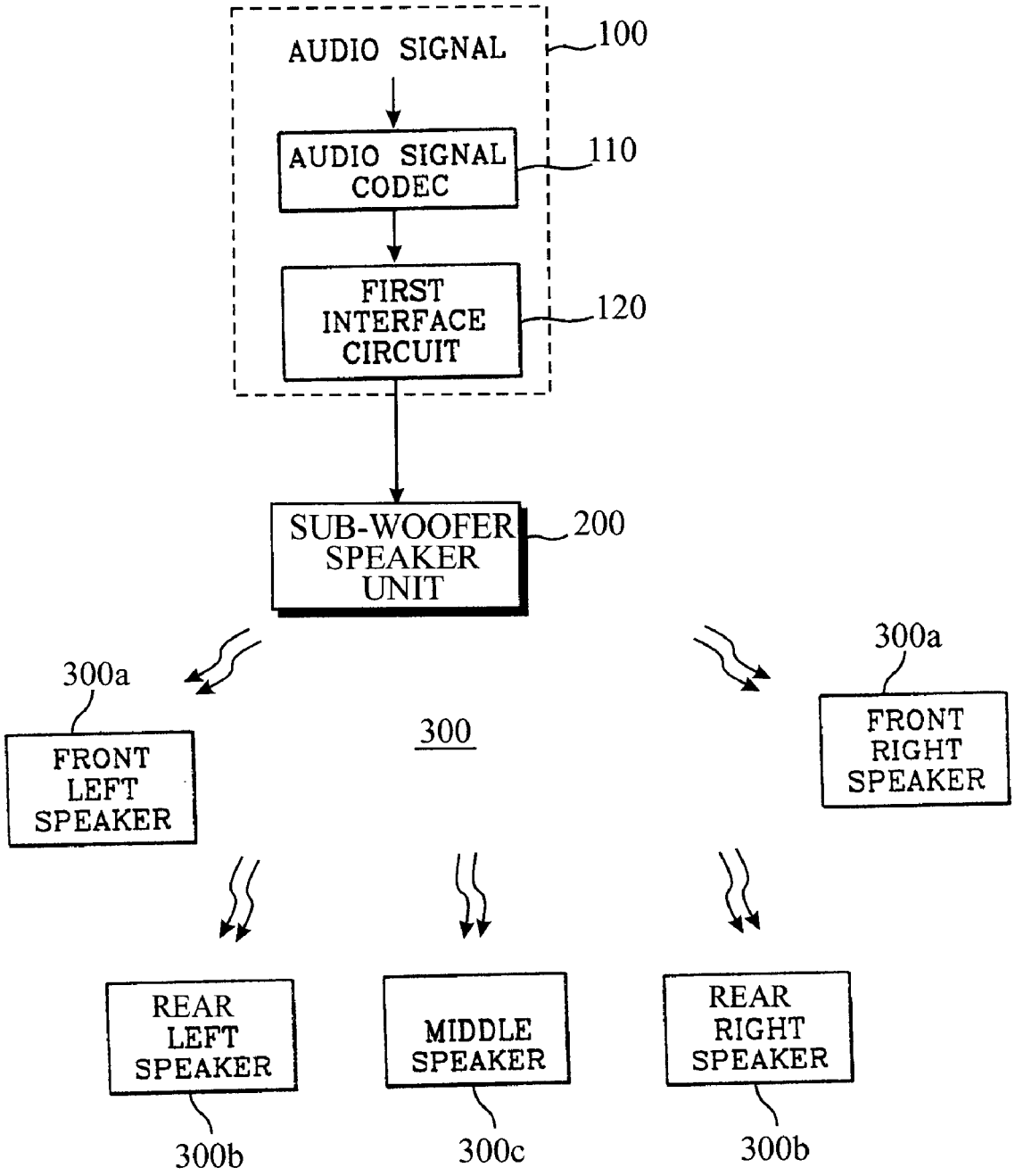
FIG. 2 illustrates an audio output apparatus having wireless speakers in accordance with the present invention.

A preferred embodiment of the present invention will now be described with reference to the accompanying drawings. FIG. 2 illustrates an audio output apparatus having wireless speakers in accordance with the present invention. As shown in this figure, audio outputting unit 100 encodes an audio signal compressed by an AC-3 compression method in accordance with an IEEE 1394 protocol so as to output it.

Sub-woofer speaker unit 200 decodes the coded audio signal provided from audio outputting unit 100, and modulates it by means of the spread spectrum FM modulation method so as to transmit it. The reason for adopting the spread spectrum FM modulation method is to extend an original signal to be modulated because, when an audio signal is modulated by a general FM modulation method, it can be converted to a completely different audio signal to be outputted due to noise encountered during its transmission.

A plurality of speaker units 300 may include front left and right speakers 300*a*, rear left and right speakers 300*b* and a middle speaker 300*c*. Sub-woofer speaker unit 200 is wirelessly connected to each speaker unit, and the modulated audio signal transmitted from sub-woofer speaker unit 200 is demodulated, amplified and outputted.

Audio outputting unit 100 includes: audio signal CODEC 110 for encoding an input audio signal in accordance with a protocol suitable to the IEEE 1394 transmission; and first interface circuit 120 for transmitting the coded audio signal provided from audio signal CODEC 110 to sub-woofer speaker 200.

Figure 3:
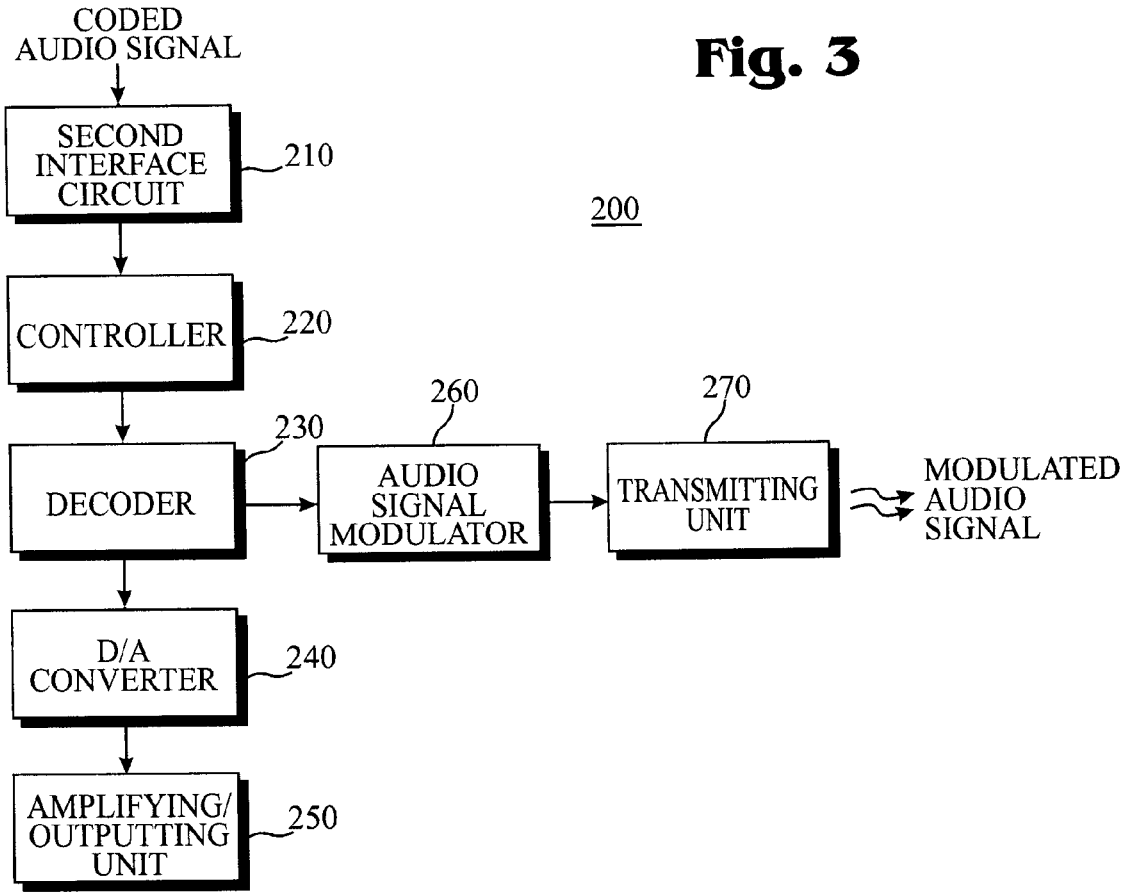
FIG. 3 is a schematic block diagram illustrating transmission of audio signal data modulated at the sub-woofer speaker unit of FIG. 2.

FIG. 3 is a schematic block diagram illustrating transmission of audio signal data modulated at the sub-woofer speaker unit of FIG. 2. As shown in this figure, sub-woofer speaker unit 200 includes: second interface circuit 210 for receiving a coded audio signal provided from audio outputting unit 100 in accordance with the IEEE 1394 protocol; controller 220 for receiving the coded audio signal provided from audio outputting unit 100 in real time, and for controlling the decoding of this signal; decoder 230 for decoding the coded audio signal inputted in accordance with the control signal of controller 220; D/A (digital/analog) converter 240 for converting a digital audio signal decoded by decoder 230 to an analogue audio signal; amplifying/outputting unit 250 for amplifying the audio signal as converted to the analog signal by D/A converter 240; audio signal modulator 260 for modulating the decoded audio signal inputted from decoder 230 by means of a spread spectrum FM modulation method; and transmitting unit 270 for transmitting the modulated audio signal inputted from audio signal modulator 260.

Figure 4:
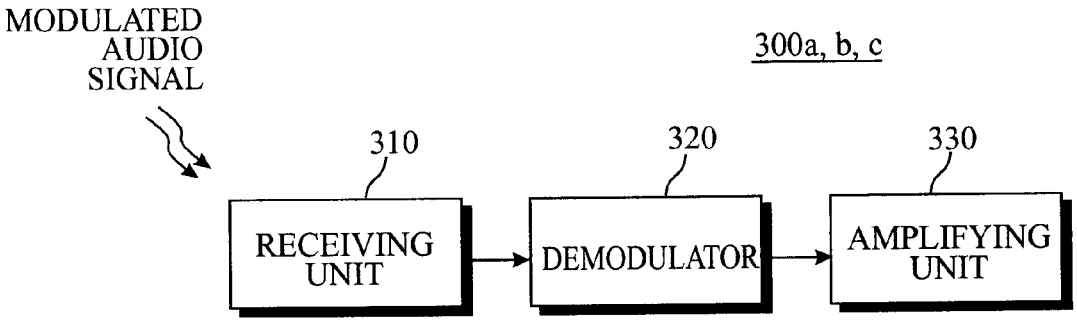
FIG. 4 is a schematic block diagram illustrating output of the audio signal received from the plurality of speakers of FIG. 2 after being demodulated.

FIG. 4 is a schematic block diagram illustrating output of the audio signal received from the plurality of speakers of FIG. 2, after being demodulated, and includes: receiving unit 310 for receiving the audio signal as modulated by the spread spectrum FM modulation method and inputted from sub-woofer speaker 200; audio signal demodulator 320 for demodulating the received audio signal to obtain an original signal; and amplifying/outputting unit 330 for amplifying and outputting the demodulated audio signal.

The operation of the audio output apparatus having the wireless speaker in accordance with the present invention as constructed above will now be described. Audio outputting unit 100 includes a reproducer (not shown) which reproduces a compressed image signal and an audio signal, and restores them to original signals. The restored image signal is outputted to a display apparatus (not shown) so as to be displayed.

Namely, the audio outputting unit refers to any apparatus, such as a computer apparatus, or an optical disk reproducer, which may have an image signal compressed by an MPEG and an audio signal compressed by the AC-3 method, and which restores and converts the compressed signal to finally output the image signal to the display apparatus and the audio signal to the speaker. Audio signal CODEC 110 provided in audio outputting unit 100 encodes the audio signal in accordance with the IEEE 1394 protocol and transmits it to sub-woofer speaker 200 through first interface circuit 120.

Then, in sub-woofer speaker 200, the audio signal encoded by the IEEE 1394 protocol is provided to decoder 230 in real-time in accordance with the control signal of controller 220 and through second interface circuit 210. Decoder 230 decodes the real-time coded audio signal to a signal suitable to be outputted in accordance with the control signal of controller 220.

The audio signal decoded by decoder 230 is outputted to D/A converter 240 and audio signal modulator 260. The audio signal outputted to D/A converter 240 is converted to an analog signal and is amplified by amplifying/outputting unit 250 so as to be outputted, while the audio signal decoded and outputted to audio signal modulator 260 is modulated according to the spread spectrum FM modulation method and is transmitted to the plurality of speakers through transmitting unit 270.

After the modulated audio signal transmitted from sub-woofer speaker 200 is received by receiving unit 310 of speakers 300*a*, 300*b*, 300*c*, it is demodulated to its original signal by demodulator 320 and is amplified by amplifying/outputting unit 330 so as to be outputted.

As described, according to the present invention, in the 5.1 channel audio output apparatus, the audio signal encoded by the IEEE 1394 protocol is outputted to the sub-woofer speaker 200, and then the audio signal modulated by the spread spectrum FM modulation method is transmitted so that signal conversion due to noise can be prevented. In addition, by wirelessly connecting the plurality of speakers 300*a*, 300*b*, 300*c* to the audio outputting unit 100 via sub-woofer speaker 200, complicated wire connections are avoided.

Although the preferred embodiment of the present invention has been disclosed for illustrative purposes; those skilled in the art will appreciate that various modifications, additions and substitutions are possible without departing from the scope and spirit of the invention as recited in the accompanying claims.

What is claimed is:

1. An audio apparatus, comprising:

an audio output unit for encoding an audio signal according to an IEEE 1394 protocol and for outputting the encoded audio signal;

a subwoofer speaker unit connected to said audio output unit for receiving said encoded audio signal from said audio output unit, for decoding said encoded audio signal to produce a decoded signal, for modulating said decoded signal by means of a spread spectrum FM modulation method to produce a modulated signal, and for wirelessly transmitting said modulated signal; and a plurality of speaker units, each of said speaker units receiving the wirelessly transmitted modulated signal, amplifying the received wirelessly transmitted modulated signal to produce an amplified signal and outputting the amplified signal;

wherein said subwoofer speaker unit comprises decoder means for receiving and decoding the encoded audio signal to produce first and second decoder outputs, converting and amplifying means for receiving, converting and amplifying the first decoder output to produce an audio output, and modulating and transmitting means for modulating the second decoder output and wirelessly transmitting the modulated second decoder output to the plurality of speaker units.

2. The audio apparatus of claim 1, wherein said decoder means comprises an interface circuit for receiving the encoded audio signal outputted from said audio output unit, a controller connected to said interface circuit for controlling the decoding of the received encoded audio signal in real time, and a decoder connected to said controller for decoding the encoded audio signal according to a control signal from said controller to obtain the first and second decoder outputs;

wherein said converting and amplifying means comprises a D/A (digital/analog) converter connected to said decoder for converting the first decoder output to obtain a converted signal, and an amplifying/output unit connected to said D/A converter for amplifying the converted signal from the D/A converter; and wherein said modulating and transmitting means comprises an audio signal modulator connected to said decoder for modulating the second decoder output from the decoder by means of a spread spectrum FM modulation method to produce a modulated output signal, and a transmitting unit connected to said audio signal modulator for transmitting the modulated output signal from the audio signal modulator.

3. The audio apparatus of claim 1, wherein said plurality of speaker units comprises a left front speaker, a right front speaker, a center speaker, a left rear speaker, and a right rear speaker forming a 5.1 channel audio system.

4. The audio apparatus of claim 1, wherein said audio output unit comprises an audio encoder for encoding the audio signal according to the IEEE 1394 protocol, and an interface circuit connected to said audio encoder for transmitting the encoded audio signal to the sub-woofer speaker unit.

5. The audio apparatus of claim 1, wherein each of said speaker units comprises a receiving unit for receiving the wirelessly transmitted modulated signal, a demodulator connected to said receiving unit for demodulating the wirelessly transmitted modulated signal to obtain a demodulated output, and an amplifying unit connected to said demodulator for amplifying the demodulated output to produce the amplified signal for output.

6. The audio apparatus of claim 1, wherein each of said speaker units is in wireless communication with said sub-woofer speaker unit for receiving the wirelessly transmitted modulated signal.

7. The audio apparatus of claim 1, wherein said decoder means comprises:

an interface circuit for receiving the encoded audio signal outputted from said audio output unit;

a controller connected to said interface circuit for receiving the encoded audio signal outputted from said audio output unit and for controlling the decoding of the received encoded audio signal in real time; and a decoder connected to said controller for decoding the encoded audio signal to obtain the first and second decoder outputs.

8. The audio apparatus of claim 7, wherein said converting and amplifying means comprises a D/A (digital/analog) converter connected to said decoder for converting the the first decoder output to obtain a converted signal.

9. The audio apparatus of claim 8, wherein said converting and amplifying means further comprises an amplifying/output unit connected to said D/A converter for amplifying the converted signal from the D/A converter.

10. The audio apparatus of claim 9, wherein said modulating and transmitting means comprises an audio signal modulator connected to said decoder for modulating the second decoder output from the decoder by means of a spread spectrum FM modulation method to produce a modulated output signal.

11. The audio apparatus of claim 7, wherein said modulating and transmitting means comprises an audio signal modulator connected to said decoder for modulating the second decoder output from the decoder by means of a spread spectrum FM modulation method to produce a modulated output signal.

12. The audio apparatus of claim 11, wherein said modulating and transmitting means further comprises a transmitting unit connected to said audio signal modulator for wirelessly transmitting the modulated output signal from the audio signal modulator to the plurality of speaker units.

13. The audio apparatus of claim 1, wherein said decoder means comprises:

an interface circuit for receiving the encoded audio signal outputted from said audio output unit; and a decoder connected to said interface circuit for decoding the encoded audio signal to obtain the first and second decoder outputs;

wherein said modulating and transmitting means comprises an audio signal modulator connected to said decoder for modulating the the second decoder output from the decoder by means of a spread spectrum FM modulation method to produce a modulated output signal.

14. The audio apparatus of claim 13, wherein said modulating and transmitting means further comprises a transmitting unit connected to said audio signal modulator for transmitting the modulated output signal from the audio signal modulator.

15. The audio apparatus of claim 1, wherein said decoder means comprises:

an interface circuit for receiving the encoded audio signal outputted from said audio output unit; and a decoder connected to said interface circuit for decoding the encoded audio signal to obtain the first and second decoder outputs;

wherein said amplifying and converting means comprises a D/A (digital/analog) converter connected to said decoder for converting the the first decoder output to obtain a converted signal.

16. The audio apparatus of claim 15, wherein said amplifying and converting means further comprises an amplifying/output unit connected to said D/A converter for amplifying the converted signal from the D/A converter.

17. The audio apparatus of claim 16, wherein said modulating and transmitting means comprises an audio signal modulator connected to said decoder for modulating the second decoder output from the decoder by means of a spread spectrum FM modulation method to produce a modulated output signal.

18. The audio apparatus of claim 17, wherein said modulating and transmitting means further comprises a transmitting unit connected to said audio signal modulator for wirelessly transmitting the modulated output signal from the audio signal modulator to the plurality of speaker units.

* * * * *